US008823757B2

(12) United States Patent
Lence et al.

(10) Patent No.: US 8,823,757 B2
(45) Date of Patent: Sep. 2, 2014

(54) THERMAL TRANSFER RIBBON FOR FINISHING A PRINTED LABEL AND METHOD OF MANUFACTURING A THERMAL TRANSFER RIBBON THERFOR

(75) Inventors: Jason L. Lence, Morristown, TN (US); Donald Eaton, Bean Station, TN (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/407,462

(22) Filed: Feb. 28, 2012

(65) Prior Publication Data

US 2013/0222509 A1 Aug. 29, 2013

(51) Int. Cl.
*B41J 31/00* (2006.01)

(52) U.S. Cl.
USPC ..... 347/217; 428/32.6

(58) Field of Classification Search
USPC ..... 347/217, 212; 428/32.6, 32.75, 32.77
See application file for complete search history.

(56) References Cited

U.S. PATENT DOCUMENTS

| | | | | |
|---|---|---|---|---|
| 3,397,980 | A * | 8/1968 | Stone | 430/8 |
| 5,317,337 | A * | 5/1994 | Ewaldt | 347/2 |
| 6,166,755 | A * | 12/2000 | Obringer et al. | 347/217 |
| 7,004,554 | B2 * | 2/2006 | Takekoshi et al. | 347/2 |

* cited by examiner

*Primary Examiner* — Huan Tran
(74) *Attorney, Agent, or Firm* — Michael Chan

(57) ABSTRACT

A thermal transfer ribbon comprises a substrate, and a clear thermal transfer coating disposed on one side of the substrate, wherein the clear thermal transfer coating is substantially devoid of pigment material. Also, a method of manufacturing a thermal transfer ribbon for finishing a printed label comprises applying to one major side surface of a substrate a clear thermal transfer coating which is substantially devoid of pigment material. Further, an apparatus comprises a label printer, a thermal transfer printer, and an in-line feeding mechanism which interconnects the label printer and the thermal transfer printer to feed a printed label from the label printer to the thermal transfer printer so that the thermal transfer printer can thermally transfer a clear thermal transfer coating to the printed label to provide a finished label.

14 Claims, 2 Drawing Sheets

FIG. 4
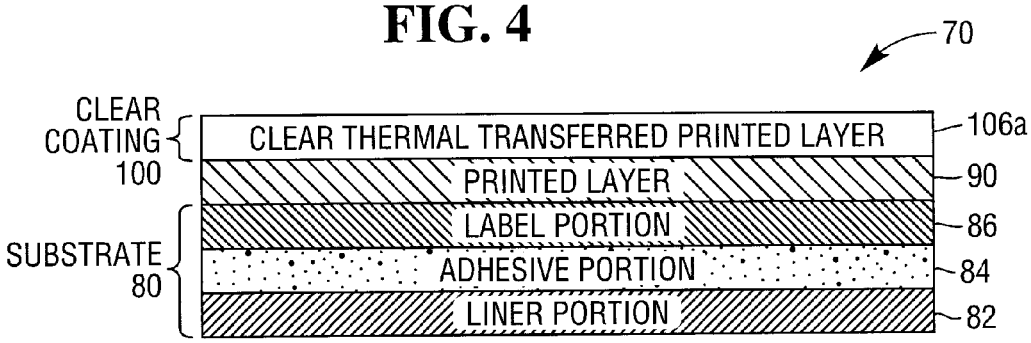
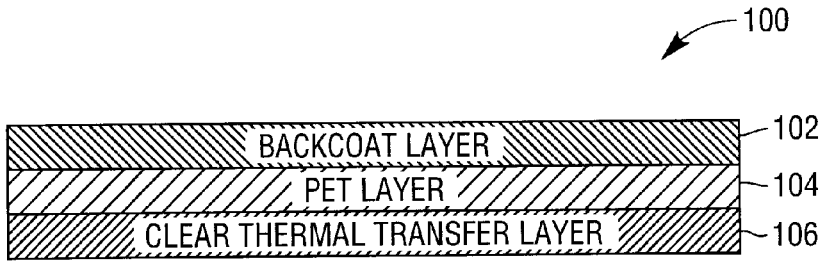
FIG. 5

THERMAL TRANSFER RIBBON FOR FINISHING A PRINTED LABEL AND METHOD OF MANUFACTURING A THERMAL TRANSFER RIBBON THERFOR

BACKGROUND

The present application relates to finishing printed labels, and is particularly directed to a thermal transfer ribbon for finishing a printed label and a method of manufacturing a thermal transfer ribbon therefor.

Printed labels obtained from label printers (e.g., laser jet, inkjet, flexographic, or lithographic) are usually laminated with a clear pressure-sensitive overlaminate to provide a finished label. As shown in the known arrangement 10 in FIG. 1, a label is printed at a label printer 12. A separate label laminator 14 then applies a clear pressure-sensitive overlaminate on the printed label to provide a finished label 20 as shown in FIG. 2.

The finished label 20 has a substrate 30 which includes a liner portion 32, an adhesive portion 34, and a label portion 36 on which layer 40 is printed by the label printer 12. The finished label 20 also has an overlaminate 50 which includes an adhesive layer 52 and a polyethylene terephthalate (PET) layer 54 applied by the label laminator 14. During the lamination process, the label laminator 14 applies the overlaminate 50 (i.e., the adhesive layer 52 and the PET layer 54) to the printed layer 40 to provide the finished label 20.

A drawback in the known arrangement 10 shown in FIG. 1 is that the label printer 12 and the label laminator 14 are different pieces of equipment. A label printed by the label printer 12 needs to be physically carried to the label laminator 14 so that the label laminator 14 can apply the clear pressure-sensitive overlaminate to provide the finished label 20 as shown in FIG. 2. Separate processes on two different pieces of equipment are involved in the known arrangement 10 shown in FIG. 1 to provide the finished label 20. It would be desirable to provide a finished label which involves only a single piece of equipment.

SUMMARY

In accordance with one embodiment, a thermal transfer ribbon comprises a substrate, and a clear thermal transfer coating disposed on one side of the substrate, wherein the clear thermal transfer coating is substantially devoid of pigment material.

In accordance with another embodiment, a method of manufacturing a thermal transfer ribbon for finishing a printed label comprises applying to one major side surface of a substrate a clear thermal transfer coating which is substantially devoid of pigment material.

In accordance with yet another embodiment, an apparatus comprises a label printer, a thermal transfer printer, and an in-line feeding mechanism which interconnects the label printer and the thermal transfer printer to feed a printed label from the label printer to the thermal transfer printer so that the thermal transfer printer can thermally transfer a clear thermal transfer coating to the printed label to provide a finished label.

BRIEF DESCRIPTION OF THE DRAWINGS

FIG. 4 is a cross-sectional view showing layers of a finished label provided by the arrangement shown in FIG. 3.

FIG. 5 is a cross-sectional view showing layers of a thermal transfer ribbon used in the thermal transfer printer of FIG. 3 and manufactured in accordance with one embodiment.

DETAILED DESCRIPTION

Figure 1:
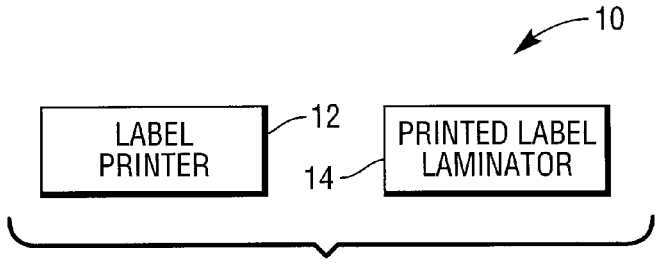
FIG. 1 PRIOR ART
FIG. 1 is a block diagram of a known arrangement of a label printer and a label laminator.
Figure 2:
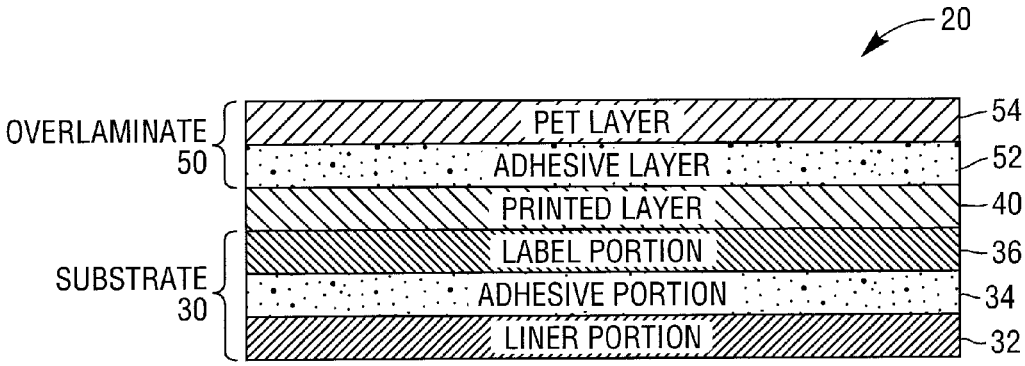
FIG. 2 PRIOR ART
FIG. 2 is a cross-sectional view showing layers of a finished label provided by the known arrangement shown in FIG. 1.
Figure 3:
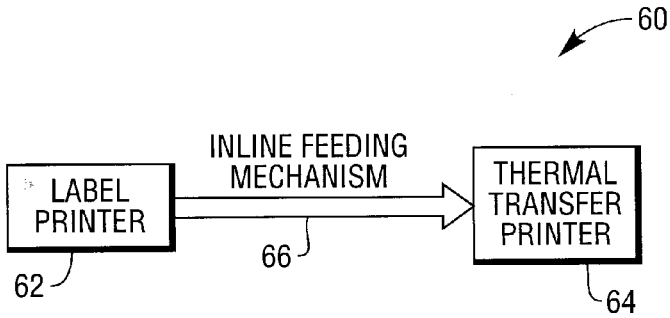
FIG. 3 is a block diagram of an arrangement of a label printer and thermal transfer printer in accordance with one embodiment.

Referring to FIG. 3, an arrangement 60 is constructed in accordance with one embodiment. The arrangement 60 comprises a label printer 62, a thermal transfer printer 64, and an in-line feeding mechanism 66 which interconnects the label printer 62 and the thermal transfer printer 64. After a label is printed by label printer 62, the printed label is mechanically transported by the in-line feeding mechanism 66 from the label printer 62 to the thermal transfer printer 64.

The label printer 62 may be any standard off-the-shelf type of label printer. For example, the label printer 62 may comprise a laser jet printer, an inkjet printer, a flexographic printer, or a lithographic printer. The thermal transfer printer 64 may be any standard off-the-shelf type of thermal transfer printer. The in-line feeding mechanism 66 may comprise any type of mechanical feeder which can mechanically transport a printed label from the label printer 62 to the thermal transfer printer 64.

After a printed label is transported from the label printer 62 to the thermal transfer printer 64, the thermal transfer printer 64 applies a clear coating 100 on the printed label to provide a durable finished label 70 as shown in FIG. 4. As shown in FIG. 4, printed label comprises substrate 80 including liner portion 82, adhesive portion 84, and label portion 86 on which printed layer 90 has been printed by label printer 62. Clear coating 100 comprises a clear thermal transferred layer **106*a* which has been applied by thermal transfer printer 64. The clear thermal transferred layer 106*a* is a melted coating of a clear thermal transfer layer 106 from a thermal transfer ribbon 110 as shown in FIG. 5**.

As shown in FIG. 5, the clear thermal transfer layer 106 is disposed on one major side surface of a polyethylene terephthalate (PET) layer 104. A protective backcoat layer 102 is disposed on the opposite major side surface of the PET layer 104. PET layer 104 may comprise an 18 gauge film, for example. Different types of PET films are known and, therefore, will not be described. Backcoat layer 102 may comprise any suitable type of coating which protects PET layer 104. Different types of protective backcoating materials are known and, therefore, will not be described.

A formulation for the clear thermal transfer layer 106 for the thermal transfer ribbon 110 shown in FIG. 5 comprises ingredients in appropriate amounts as set forth in the following example. Availability of the various ingredients used in the example below is provided by the following companies:

| Ingredients | Companies |
|---|---|
| Kraton G-1652 | Kraton Performance Polymers, Inc. |
| Paraloid DM-55 | The Dow Chemical Company |
| Polywax 400 | Baker Hughes |
| Mineral Spirits | Ashland, Inc. |
| Vybar C-6112 | Baker Hughes |

Ingredients and their amounts are as follows:

| | |
|---|---|
| Kraton G-1652 | 4.4 pounds |
| Paraloid DM-55 | 8.7 pounds |
| Polywax 400 | 28.2 pounds |
| Mineral Spirits | 353 pounds |
| Vybar C-6112 | 110 pounds |
| Total batch | 504.3 pounds |

Kraton G-1652 is a translucent, linear triblock copolymer based on styrene and ethylene/butylene (SEBS) with a styrene/rubber ratio of 30/70. Paraloid DM-55 is a 100% solids acrylic resin with a compatibility with a wide variety of other resins including acrylics, vinyls, epoxies and polyester. Polywax 400 is a polyethylene which is a fully saturated homopolymer of ethylene that exhibits a high degree of linearity and crystallinity. Mineral spirits is a paraffin-derived clear, transparent liquid which is a common organic solvent. Vybar C-6112 is a polymer having a combination of acid functionality with the Vybar polymer's hyperbranched structure.

Mineral spirits is first added and heated to 200° F. The Kraton, the Polywax 400, and the Vybar C-6112 are added to the mineral spirits while under high agitation. After ingredients have melted or dissolved, wait until the temperature goes back up to 200° F. The Paraloid DM-55 is slowly added while under high agitation to mix the ingredients. Mixing is continued under high agitation until all of the Paraloid DM-55 is dissolved. Total mixing time takes about one to about two hours.

It is noted that the above mixture is substantially devoid of pigment material and dye material since a clear and transparent thermal transfer layer of a thermal transfer ribbon is desired.

The above mixture is then applied to one major side surface of a PET film using conventional coating equipment and conventional coating techniques. Conventional coating equipment and conventional coating techniques are well known and, therefore, will not be described.

The following conditions may be used when using a Mayer rod coater for applying the mixture to the PET film:

| Condition | |
|---|---|
| Line Speed (feet/minute) | 750 |
| Dryer 1 (degrees F.) | 200 |
| Dryer 2 (degrees F.) | 170 |
| Fan 1 (cubic feet/minute) | 1050 |
| Fan 2 (cubic feet/minute) | 900 |
| Mayer Rods | #12 |
| Coating Thickness (microns) | 3 |

Although the various ingredients used in the above-described example are provided by the named companies, it is conceivable that other companies may provide the same or equivalent ingredients under different names. Also, although the above description describes a Mayer rod coater being used, it is conceivable that a different type of coater be used. As an example, a Gravure coater may be used.

During application of the mixture to the one major side surface of the PET film, no pigments or dyes are added because the mixture needs to provide the clear and transparent thermal transfer layer 106 of the thermal transfer ribbon 110 shown in FIG. 5. After the mixture has been applied to the one major side surface of the PET film, a suitable backcoating material is applied to the other major side surface of the PET film to provide the thermal transfer ribbon 110.

A thermal transfer ribbon manufactured in accordance with the above described process was used in a conventional thermal transfer printer to apply a clear finish coating on a printed label from a conventional label printer. The clear finish coating had a coating thickness of about three microns. The clear finish coating was expected to be in the range of one to five microns. It was noted that substantially all of the material of the clear thermal transfer layer of the thermal transfer ribbon is transferred to the printed layer of the printed label to provide the finished label.

It should be apparent that the thermal transfer printer 64 (as shown in FIG. 3) operates to transfer the clear thermal transfer layer 106 of the thermal transfer ribbon 110 (as shown in FIG. 5) as a clear thermal transferred printed layer **106*a* onto the printed layer 90 (as shown in FIG. 4) to provide the finished label 70. The clear thermal transferred printed layer 106*a* shown in FIG. 4 functions as a durable protection layer of the finished label 70**. Accordingly, no separate piece of equipment in the form of a laminator is needed to provide an overlaminated layer.

It should also be apparent that the arrangement 60 shown in FIG. 3 allows a finished label to be provided in a single pass from the label printer 62 through the in-line feeding mechanism 66 to the thermal transfer printer 64. Accordingly, there is no need to physically carry a label printed by the label printer 62 from the label printer 62 to the thermal transfer printer 64. In-line feeding mechanism 66 operates to feed a printed label from the label printer 62 to the thermal transfer printer 64 without any human intervention.

Although the above description describes a thermal transfer ribbon including a substrate in the form of a PET film, it is conceivable that other types of substrates may be used. For examples, a bi-axially oriented polypropylene (BOPP) film, a linear low density polyethylene (LLDPE) film, or a high density polyethylene (HDPE) film may be used. Known or proprietary substrates may be used. Also, known or proprietary backcoating materials may be used.

Also, although the above description describes a clear finish coating being applied to a printed label which has a liner and adhesive, it is conceivable that a clear finish coating be applied to a printed tag which does not have a liner and adhesive.

While the present invention has been illustrated by the description of example processes and system components, and while the various processes and components have been described in detail, applicant does not intend to restrict or in any limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A thermal transfer ribbon comprising:

a substrate; and a clear thermal transfer coating disposed on one side of the substrate, wherein the clear thermal transfer coating is substantially devoid of pigment material, wherein (i) substantially all of the material of the clear thermal transfer coating is transferable to a printed layer of a printed label to provide a finished label, and (ii) the clear thermal transfer coating comprises a mixture of mineral spirits and a translucent, linear triblock copolymer.

2. A thermal transfer ribbon according to claim 1, wherein the mixture further comprises an acrylic resin mixed with a polyethylene which is a fully saturated homopolymer of ethylene.

3. A thermal transfer ribbon according to claim 1, wherein the substrate comprises polyethylene terephthalate (PET).

4. A thermal transfer ribbon according to claim 1, wherein the translucent, linear triblock copolymer is based on styrene and ethylene/butylene with a styrene/rubber ratio of 30/70.

5. A method of manufacturing a thermal transfer ribbon for finishing a printed label, the method comprising:

applying to one major side surface of a substrate a clear thermal transfer coating which is substantially devoid of pigment material, wherein the clear thermal transfer coating comprises a mixture of mineral spirits and a translucent, linear triblock copolymer.

6. A method according to claim 5, further comprising:

applying a backcoating to an opposite major side surface of the substrate.

7. A method according to claim 6, wherein substantially all of the material of the clear thermal transfer coding is transferable to a printed layer of the printed label to provide a finished label.

8. A method according to claim 5, wherein the mixture further comprises an acrylic resin mixed with a polyethylene which is a fully saturated homopolymer of ethylene.

9. A method according to claim 8, wherein the substrate comprises polyethylene terephthalate (PET).

10. A method according to claim 5, wherein the translucent, linear triblock copolymer is based on styrene and ethylene/butylene with a styrene/rubber ratio of 30/70.

11. A thermal transfer ribbon comprising:

a substrate; and a clear thermal transfer coating disposed on one side of the substrate, wherein the clear thermal transfer coating is substantially devoid of pigment material and comprises at least one of (i) a mixture of mineral spirits and a translucent, linear triblock copolymer, and (ii) an acrylic resin mixed with a polyethylene which is a fully saturated homopolymer of ethylene.

12. A thermal transfer ribbon according to claim 11, wherein substantially all of the material of the clear thermal transfer coating is transferable to a printed layer of a printed label to provide a finished label.

13. A thermal transfer ribbon according to claim 11, wherein the substrate comprises polyethylene terephthalate (PET).

14. A thermal transfer ribbon according to claim 11, wherein the translucent, linear triblock copolymer is based on styrene and ethylene/butylene with a styrene/rubber ratio of 30/70.

* * * * *